US007069627B2

(12) United States Patent
Cunningham et al.

(10) Patent No.: US 7,069,627 B2
(45) Date of Patent: Jul. 4, 2006

(54) DECORATIVE COVER FOR CASKET SHELL FLANGE

(75) Inventors: Gary Cunningham, Greensburg, IN (US); Donald Maple, Batesville, IN (US); Greg Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 10/686,373

(22) Filed: Oct. 15, 2003

(65) Prior Publication Data

US 2005/0081348 A1 Apr. 21, 2005

(51) Int. Cl.
*A61G 17/00* (2006.01)

(52) U.S. Cl. ..... 27/19

(58) Field of Classification Search ..... 27/2, 27/4, 6, 7, 17, 19
See application file for complete search history.

(56) References Cited

U.S. PATENT DOCUMENTS

| | | | | |
|---|---|---|---|---|
| 1,500,141 | A | 7/1924 | MacDonald | |
| 1,977,584 | A | 10/1934 | Hansen | 27/19 |
| 2,250,704 | A | 7/1941 | Donnelly | |
| 2,943,376 | A | 7/1960 | Bashuk | |
| 3,218,688 | A | 11/1965 | Slaughter | 27/19 |
| 3,233,302 | A | 2/1966 | Ross | 27/6 |
| 3,810,281 | A | 5/1974 | Ferber | 27/19 |
| 3,892,417 | A | 7/1975 | Clayton | 277/207 |
| 4,003,109 | A * | 1/1977 | Matichak | 27/19 |
| 4,882,821 | A * | 11/1989 | Sims, Jr. | 27/17 |
| 4,930,197 | A * | 6/1990 | McClive | 27/2 |
| 5,639,072 | A | 6/1997 | McCall | |
| 5,740,592 | A * | 4/1998 | Lau | 27/4 |
| 5,970,590 | A * | 10/1999 | Tambussi | 27/7 |
| 5,974,640 | A | 11/1999 | Vosahlik et al. | 27/2 |
| 6,019,336 | A | 2/2000 | Havens | |
| 6,378,831 | B1 | 4/2002 | Copeland, Jr. | |
| 6,438,249 | B1 * | 8/2002 | Wiener | 381/388 |

FOREIGN PATENT DOCUMENTS

EP 0 776 619 A1 6/1997

* cited by examiner

*Primary Examiner*—William L. Miller
(74) *Attorney, Agent, or Firm*—Wood, Herron & Evans, LLP

(57) ABSTRACT

A casket comprises a shell having a pair of opposed side walls and a pair of opposed end walls, the walls defining an upper edge of the shell, a lid closeable upon the edge of the shell and a cover securable to the shell and concealing the edge when the lid is open, the cover being at least semi-rigid.

20 Claims, 3 Drawing Sheets

DECORATIVE COVER FOR CASKET SHELL FLANGE

FIELD OF THE INVENTION

This invention relates generally to the death care industry, and more particularly to caskets and decorative treatments therefor.

BACKGROUND OF THE INVENTION

Caskets, whether fabricated of wood or metal, have traditionally been provided with attractive exteriors. Finely polished wood and metal finishes are typically provided for wood and metal caskets, respectively. Further, caskets have traditionally been provided with decorative exterior hardware, for example, decorative carrying handle bars and decorative "ears" or "escutcheons" covering the attachment points of the handle bars to the casket shell. Still further, caskets are typically provided with decorative corner ornaments mounted to the corners of the casket shell.

Caskets have also traditionally been outfitted with decorative interiors. These interiors have taken the form of a decorative cap panel and peripheral puffing mounted in the underside of the casket cap or lid, a pillow, and shirred or other decorative fabric lining the interior side walls and head end end wall of the casket shell. In addition, the side wall of the casket shell opposite the hinge connection of the cap to the shell, as well as the head end end wall of the casket shell, typically carry an additional, larger, piece of shirred or other decorative fabric for overlaying the top edge of the casket shell during periods when the casket cap is opened for presentation and viewing of the deceased. The smaller decorative fabric portions which line the interior side walls and head end end wall of the casket shell are each known as a "small body," whereas the larger piece of decorative fabric which is placed over the casket shell edge during presentation and viewing is known as the "big body." The big body thus provides a means for concealing the shell upper edge or flange during presentation and viewing, presenting a finished look. In the case of "sealer" metal caskets which carry a rubber flange gasket on the shell edge to provide a seal between shell and cap, the big body conceals the gasket. Polyester or other batting material is typically included in the small and big bodies in order to provide firmness, fullness, etc.

A drawback to the traditional fabric big body is that, when deployed over the edge of the casket shell during presentation and viewing, it tends to hang down over a portion or all of the decorative escutcheons, corner ornaments and/or decorative surface, of the casket shell. It is therefore desirable to provide a decorative cover treatment for the casket shell edge, which does not conceal these decorative features of the casket shell.

Another drawback to the traditional fabric big body is that it has a bulky, dated appearance. It is therefore desirable to provide a more contemporary look to the casket by eliminating the current bulky big body.

Yet another drawback to the traditional fabric big body is that it requires time intensive, tedious manual smoothing, straightening and/or manipulation of the fabric to present the best appearance of the big body, due to the flaccid nature of the fabric. It is therefore desirable to provide a decorative cover treatment for the casket shell edge, which does not require such attention.

SUMMARY OF THE INVENTION

The present invention is a casket comprising a shell having a pair of opposed side walls and a pair of opposed end walls, the walls defining an upper edge of the shell, a lid closeable upon the edge of the shell and a cover securable to the shell and concealing the edge when the lid is open, the cover being at least semi-rigid.

The cover preferably conceals only the edge of the shell. The casket can be fabricated of either wood or metal. If metal, the shell edge can carry a rubber gasket for sealing between the shell and the lid, the cover concealing the gasket.

The cover can be fabricated from a plastic, cardboard, wood or metal. If plastic, the cover can be molded or extruded. If cardboard, the cover can be covered with a decorative fabric, painted or printed with decorative surface ornamentation.

The casket can further include a means for removably securing the cover to the shell. As one example, a press-fit connection between the cover and shell edge can be accomplished by utilizing a cover having a sufficient resilience and of such a configuration that the cover snaps onto the shell edge. As another example, the cover and shell edge can include studs and apertures, with either the cover or the shell carrying studs and the other having apertures therein which accept the studs. As yet another example, the cover and shell edge can utilize double-sided tape. As still another example, the cover and shell edge can utilize a hook and loop fastener.

The cover can include an engraveable plate mounted thereon, or can itself be engraved with an inscription memorializing the deceased.

The decorative casket shell flange cover of this invention thus provides a decorative cover treatment for the casket shell edge, which does not conceal the various other decorative features of the casket shell, such as escutcheons, corner ornaments and the shell surface itself.

It also imparts a more contemporary look to the casket by eliminating the current bulky big body.

Still further, the decorative casket shell flange cover of this invention eliminates the mandatory time intensive, tedious manual smoothing, straightening and/or manipulation of the fabric attendant with fabric big bodies.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
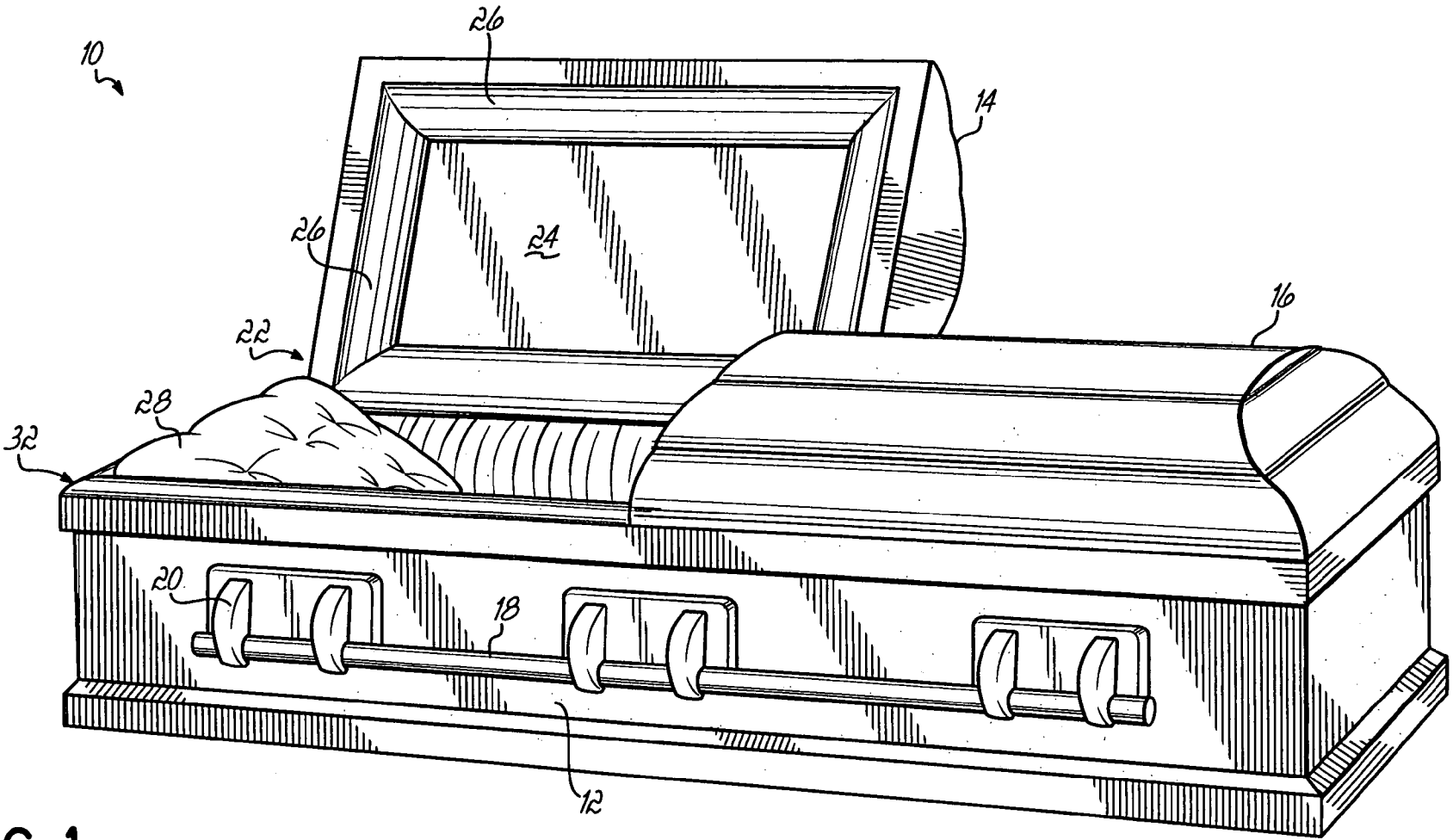
FIG. 1 is a perspective view of a casket with shell edge covers.

Referring first to FIG. 1, there is illustrated a casket 10 of this invention. The casket 10 can be fabricated from any suitable material suitable for above ground interment, in ground burial or cremation, such as wood, metal, plastic, cardboard, fiberboard etc., and includes a lower body containing portion or shell 12, a head end cap or lid 14 which can be pivoted to a rear upper edge of the shell 12 and a foot end cap or lid 16 which likewise can be pivoted to the rear upper edge of the shell 12. Casket 10 could just as well be of the so-called "full couch" type, having only a single, full-length cap or lid. Casket 10 can also include carrying handle bars 18 and decorative escutcheons 20 covering the interconnections of the handle bars 18 to the shell 12.

The casket 10 can also include a decorative interior 22, including a cap panel 24 with a peripheral puffing 26 therearound, mounted to the underside of the head end cap 14. Cap panel 24 and puffing 26 can be fabricated of fabric-covered sheet-like material ("chipboard"). Interior 22 can further include a pillow 28 (with or without a pillow "case"), and "shirred" or other decorative fabric portions 30 lining the interior walls of the casket shell 12 and known as a "small body."

In stark contrast to previous casket decorative interiors, the interior 22 of the FIG. 1 casket 10 does not include the additional, larger piece of shirred or other decorative fabric, known as a "big body," for overlaying the top edge of the casket shell during periods when the casket cap 14 is opened for presentation and viewing of the deceased. Rather, the casket 10 includes a rigid or semi-rigid decorative shell edge cover 32, the edge cover 32 being rigid or semi-rigid as compared to a traditional flaccid fabric big body.

Figure 2A:
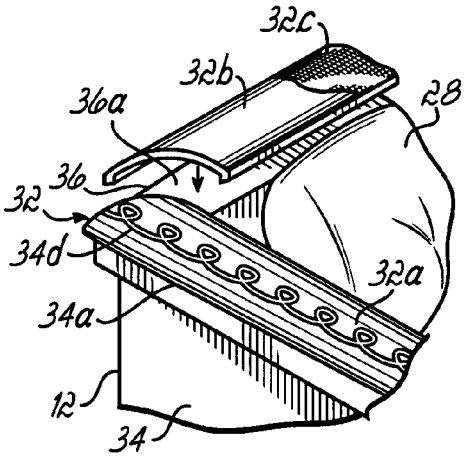
FIG. 2A is an enlarged partial perspective view of one corner of the casket with shell edge covers of FIG. 1.

Referring now to FIG. 2A, it will be seen that shell 12 includes a side wall 34 and a head end end wall 36. Each side wall 34 and head end end wall 36 includes a respective upper edge 34*a*, 36*a*, respectively. Collectively upper edges 34*a*, 36*a* form an upper edge or flange of shell 12. Decorative shell edge cover 32 is illustrated as having been fabricated in two mitered parts, a side portion 32*a* and an end portion 32*b*. As illustrated, the edge cover 32 is elongated, being relatively narrow in comparison to its length, and preferably conceals only the edge of the shell 12, i.e. is preferably no wider than the upwardly flange or edge of the shell 12. Edge cover 32 is preferably fabricated from a rigid, or at least semi-rigid, material, such as plastic, cardboard, wood or metal; edge cover 32 could even be fabricated from simply a strip of heavily starched fabric so as to be semi-rigid. A plastic edge cover 32 could be fabricated by, for example, molding or extruding. If cardboard, edge cover 32 could be covered with decorative fabric 32*c*, painted or otherwise printed with decorative surface ornamentation 34*d*. If casket 10 is fabricated of metal, the shell edge may carry a rubber gasket 33 (FIG. 3B) for sealing between the shell 12 and lid 14. In that case the edge cover 32 conceals the gasket 33.

Figure 2B:
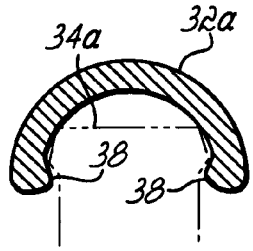
FIG. 2B is a view taken along 2B—2B of FIG. 1 illustrating one means of securing the shell edge covers to the shell edge.

Referring now to FIG. 2B, one example of a means for removably securing the shell edge cover 32 to the shell 12 is illustrated. In this embodiment, the cover 32 material is selected and the cover 32 itself is configured such that the resilience of the cover 32 allows it to snap onto the shell edge. For example, the cover 32 in FIG. 2B could be fabricated of plastic, cardboard, wood or sheet metal. Including inwardly directed extensions 38, 38 help to retain the cover 32 on the shell edge.

Figure 3A:
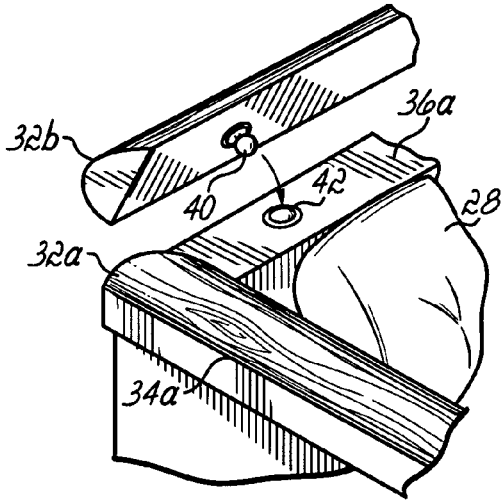
FIG. 3A is a view similar to FIG. 2A illustrating another means of securing the shell edge covers to the shell edge.
Figure 3B:
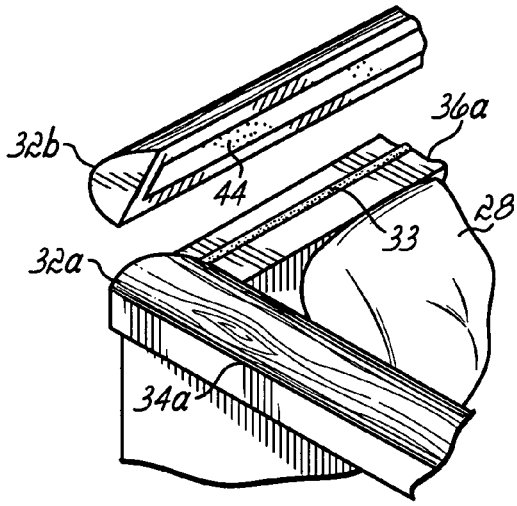
FIG. 3B is a view similar to FIG. 3A illustrating yet another means of securing the shell edge covers to the shell edge.
Figure 3C:
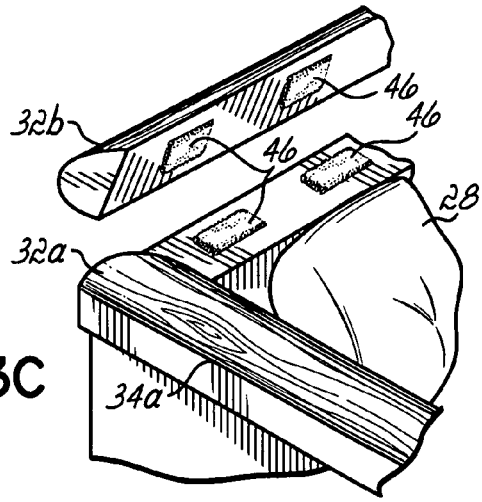
FIG. 3C is a view similar to FIG. 3B illustrating still another means of securing the shell edge covers to the shell edge.

Referring now to FIGS. 3A–C, various other alternative means for removably securing the cover 32 to the shell 12 are illustrated. As another example, and referring now to FIG. 3A, the cover 32 and shell edge can include cooperating studs 40 and apertures 42, with either the cover 32 or the shell 12 carrying the studs 40 and the other having the apertures 42 therein which accept the studs 40. As yet another example, and referring now to FIG. 3B, the cover 32 and shell edge can utilize double-sided tape 44 to adhere one to another. As still another example, and referring now to FIG. 3C, the cover 32 and shell edge can utilize a hook and loop fastener 46 to secure one to another.

Figure 4:
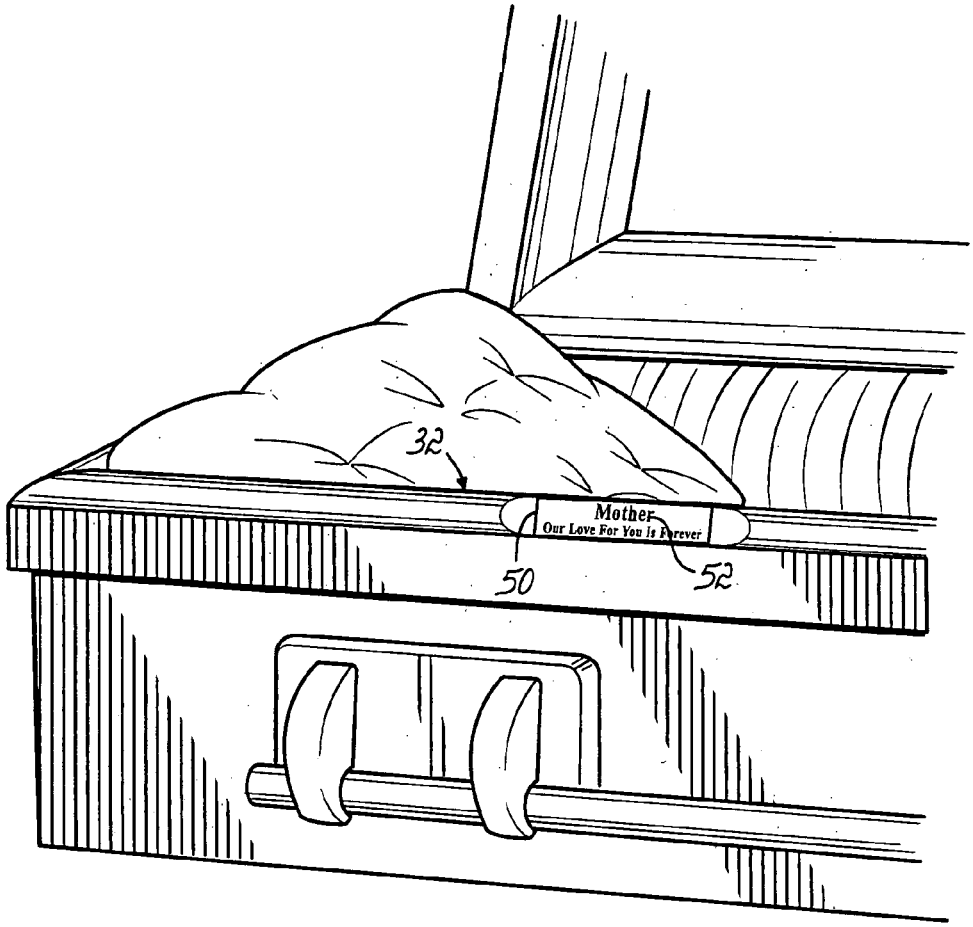
FIG. 4 is a partial perspective view of a casket with a wood shell edge cover including engraved name plate.
Figure 5:
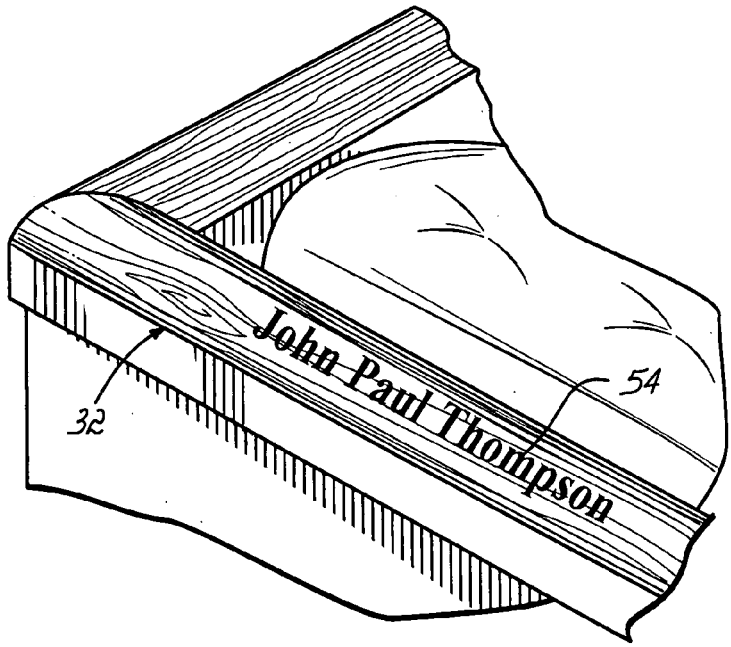
FIG. 5 is a partial perspective view of a casket with an engraved wood shell cover.

Referring now to FIGS. 4 and 5, a personalized edge cover 32 is illustrated. In FIG. 4, the edge cover 32 includes an engraveable plate 50 bearing an inscription of memorialization 52 engraved thereon. In FIG. 5, an edge cover 32 is illustrated which itself is engraved with an inscription of memorialization 54 thereon.

Those skilled in the art will readily recognize numerous adaptations and modifications which can be made to the present invention which will result in an improved decorative cover for the flange of a casket shell, yet all of which will fall within the spirit and scope of the present invention as defined in the following claims. Accordingly, the invention is to be limited only by the scope of the following claims and their equivalents.

What is claimed is:

1. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid, said cover adapted to be removed from said shell edge for proper closing of said lid on said shell edge wherein said cover is no wider than said upper edge whereby said cover conceals only said upper edge of said shell.

2. The casket of claim 1 wherein said casket is fabricated of wood.

3. The casket of claim 1 wherein said casket is fabricated of metal.

4. The casket of claim 1 wherein said semi-rigid cover is fabricated from a plastic.

5. The casket of claim 4 wherein said plastic cover is molded.

6. The casket of claim 4 wherein said plastic cover is extruded.

7. The casket of claim 1 wherein said semi-rigid cover is fabricated from cardboard.

8. The casket of claim 1 wherein said semi-rigid cover is fabricated from wood.

9. The casket of claim 1 wherein said semi-rigid cover is fabricated from metal.

10. The casket of claim 1 further including means for removably securing said cover to said shell.

11. The casket of claim 10 wherein said means comprises stud and aperture connections, one of said shell edge and lid carrying studs and the other of said shell edge and lid having aperture therein which accept said studs.

12. The casket of claim 10 wherein said means comprises double-sided tape.

13. The casket of claim 10 wherein said means comprises a hook and loop fastener.

14. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said casket is fabricated of metal;

wherein said shell edge carries a rubber gasket for sealing between said shell and lid, and wherein said cover conceals said gasket, and wherein said cover is no wider than said upper edge whereby said cover conceals only said upper edge of said shell.

15. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said semi-rigid cover is fabricated from cardboard;

wherein said cardboard cover is covered with decorative fabric, and wherein said cover is no wider than said upper edge whereby said cover conceals only said upper edge of said shell.

16. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said semi-rigid cover is fabricated from cardboard;

wherein said cardboard cover is painted, and wherein said cover is no wider than said upper edge whereby said cover conceals only said upper edge of said shell.

17. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said semi-rigid cover is fabricated from cardboard;

wherein said cardboard cover is printed with decorative surface ornamentation, and wherein said cover is no wider than said upper edge whereby said cover conceals only said upper edge of said shell.

18. A casket comprising: a shell having a pair of opposed side walls and a pair of opposed end walls, said walls defining an upper edge of said shell; a lid closeable upon said edge of said shell; and a one-piece cover removably securable to said shell and concealing said edge when said lid is open, said cover being at least semi-rigid, said cover adapted to be removed from said shell edge for proper closing of said lid on said shell edge, and wherein said cover is removably secured to said shell via; a press-fit connection between said cover and said shell edge, said cover having sufficient resilience and being configured such that said cover snaps onto said shell edge.

19. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said cover includes an engraveable plate mounted thereon and wherein said cover is no wider than said upper edge whereby said cover conceals only said upper edge of said shell; and.

20. A casket comprising:

a shell having a pair of opposed side walls and a pair of opposed end walls, said walls defining an upper edge of said shell;

a lid closeable upon said edge of said shell; and a cover removably securable to said shell and concealing said edge when said lid is open, said cover being at least semi-rigid;

wherein said cover is engraved with an inscription memorializing the deceased wherein said cover is no wider than said upper edge whereby said cover conceals only said upper edge of said shell.

* * * * *

UNITED STATES PATENT AND TRADEMARK OFFICE

CERTIFICATE OF CORRECTION

PATENT NO. : 7,069,627 B2
APPLICATION NO. : 10/686373
DATED : July 4, 2006
INVENTOR(S) : Gary Cunningham, Donald Maple and Greg Wray It is certified that error appears in the above-identified patent and that said Letters Patent is hereby corrected as shown below:

Col. 6, line 18, Claim 18 reads: "is removably secured to said shell via; a press-fit connection"; it should read: -- is removably secured to said shell via a press-fit connection --.

Col. 6, line 31, Claim 19 reads: "thereon and wherein said cover is no wider than said"; it should read: -- thereon, and wherein said cover is no wider than said --.

Col. 6, line 33, Claim 19 reads: "upper edge of said shell; and."; it should read: -- upper edge of said shell. --.

Signed and Sealed this

Twenty-first Day of October, 2008

JON W. DUDAS
*Director of the United States Patent and Trademark Office*